US005272589A

United States Patent [19]

Wrenbeck

[11] Patent Number: 5,272,589

[45] Date of Patent: Dec. 21, 1993

[54] POWER CONTROL IN RELAY COILS

[75] Inventor: Bruce R. Wrenbeck, Dearborn, Mich.

[73] Assignee: United Technologies Automotive, Inc., Dearborn, Mich.

[21] Appl. No.: 388,195

[22] Filed: Aug. 1, 1989

[51] Int. Cl.[5] ..... H01H 47/22

[52] U.S. Cl. ..... 361/152; 361/187

[58] Field of Search ..... 307/10.1, 31, 113, 115, 307/441, 219; 323/282, 283, 284, 272, 268-271; 361/152, 153, 154, 187, 205, 160, 170, 186, 187, 190, 191, 195, 196, 197, 198, 18

[56] References Cited

U.S. PATENT DOCUMENTS 3,414,736 12/1968 Hagee ..... 307/219
4,074,182 2/1978 Weischedel ..... 323/272
4,214,290 7/1980 Sloan ..... 361/154
4,745,514 5/1988 Takeshima et al. ..... 361/154
4,812,945 3/1989 D'Onofrio ..... 361/154
4,878,147 10/1989 Oyama et al. ..... 361/154
4,905,120 2/1990 Grembowicz et al. ..... 361/154
4,979,066 12/1990 Kawata et al. ..... 361/10

*Primary Examiner*—A. D. Pellinen
*Assistant Examiner*—Aditya Krishnan
*Attorney, Agent, or Firm*—Robert E. Greenstien

[57] ABSTRACT

Power dissipation across the coils in a relay control system is controlled by regulating the voltage across all the coils with a regulator that senses the voltage and varies the conduction time of the switch carrying the total coil current. The regulator includes timing and logic elements that sense if the switch is operating correctly. Another switch is operated by the logic elements to shunt the first switch when the first switch is not operating correctly. This ensures that normal coil function is available in the event of a first switch failure.

12 Claims, 3 Drawing Sheets

BATTERY
10
INPUT 1
INPUT 2
INPUT 3
INPUT 4
C1
C2
C3
C4
ISOLATOR
VOLTAGE PROTECTION
VOLTAGE REFERENCE
30
28
28.1
REF
V+
VOLT. PROT.
33
TIMER
31
LOGIC
32
BYPASS
SWITCH A
SWITCH B
20
22
18
12
14
16
T1
T2
BDR
PWM
$T_1/T_2$=KAOUT
24
22.1
ON/OFF
B
A
AOUT
26
REF
28.1
V+

POWER CONTROL IN RELAY COILS

TECHNICAL FIELD

This invention relates to techniques for regulating the voltage across a relay coil.

BACKGROUND OF THE INVENTION

In a typical automobile, many relays are connected through control switches to the battery. Battery voltage can vary widely depending on the condition of the battery, the charging system, load changes and ambient conditions. Power dissipation across an energized relay coil is a function of the square of that voltage and appears as coil heating. Excessive heat can destroy the relay coil and the coil container and the associated electronics that reside with the relay's in a typical electronic module. To the extent that the battery voltage varies and there are tolerances in the power dissipation capacities, it is desirable to maintain the voltage across a relay coil as constant as possible.

A relay coil requires a minimum voltage across its terminals in order to ensure actuation of its switch contacts. Any voltage in excess of this minimum "pull-in" voltage increases the coil power dissipation and is lost in the form of heat. Therefore, it is desirable to regulate the coil voltage to a value greater than the minimum "pull-in" to minimize the power dissipation and heat generation.

DISCLOSURE OF THE INVENTION

An object of the present invention is to provide a technique that inexpensively regulates the voltage across a plurality of relay coils in a commonly powered system, such as an automobile.

Another object of the invention is to provide that the normal—unregulated—application of voltage to those relays will take place if regulation fails, thus ensuring that normal relay functions will continue.

According to the present invention, the normal connection between a relay control and the relay's coil is augmented by a circuit that senses the voltage on one coil terminal and adjusts the circuit connection from that terminal through the coil to ground in a time function related to the difference between that voltage and a reference voltage. When power is applied to that terminal, a test is made to see if the augmenting circuit is operating; if it is not, the augmenting circuit's connection from the coil is shunted, which allows for normal—unregulated—current flow through the coil. This test is made automatically during the time that the coil is energized. If a failure in the regulation process occurs during that time the regulator is shunted.

According to the invention, an isolation circuit is used to couple multiple relay control connections to one regulator, which is connected to one terminal of each coil. This regulator controls the collective flow through the coils as function of the collective voltage, and, in that way, maintains a constant voltage drop across all of them.

A feature of the invention is that it can be incorporated into existing systems inexpensively to precisely control relay coil voltage. Another feature is that it provides redundancies that assure that normal relay operation is available at all times. Other object benefits and features will become apparent from the following discussion of the invention.

Another feature of the invention is that the proper pull-in voltages can be selected and regulated.

BEST MODE FOR CARRYING OUT THE INVENTION

Figure 1:
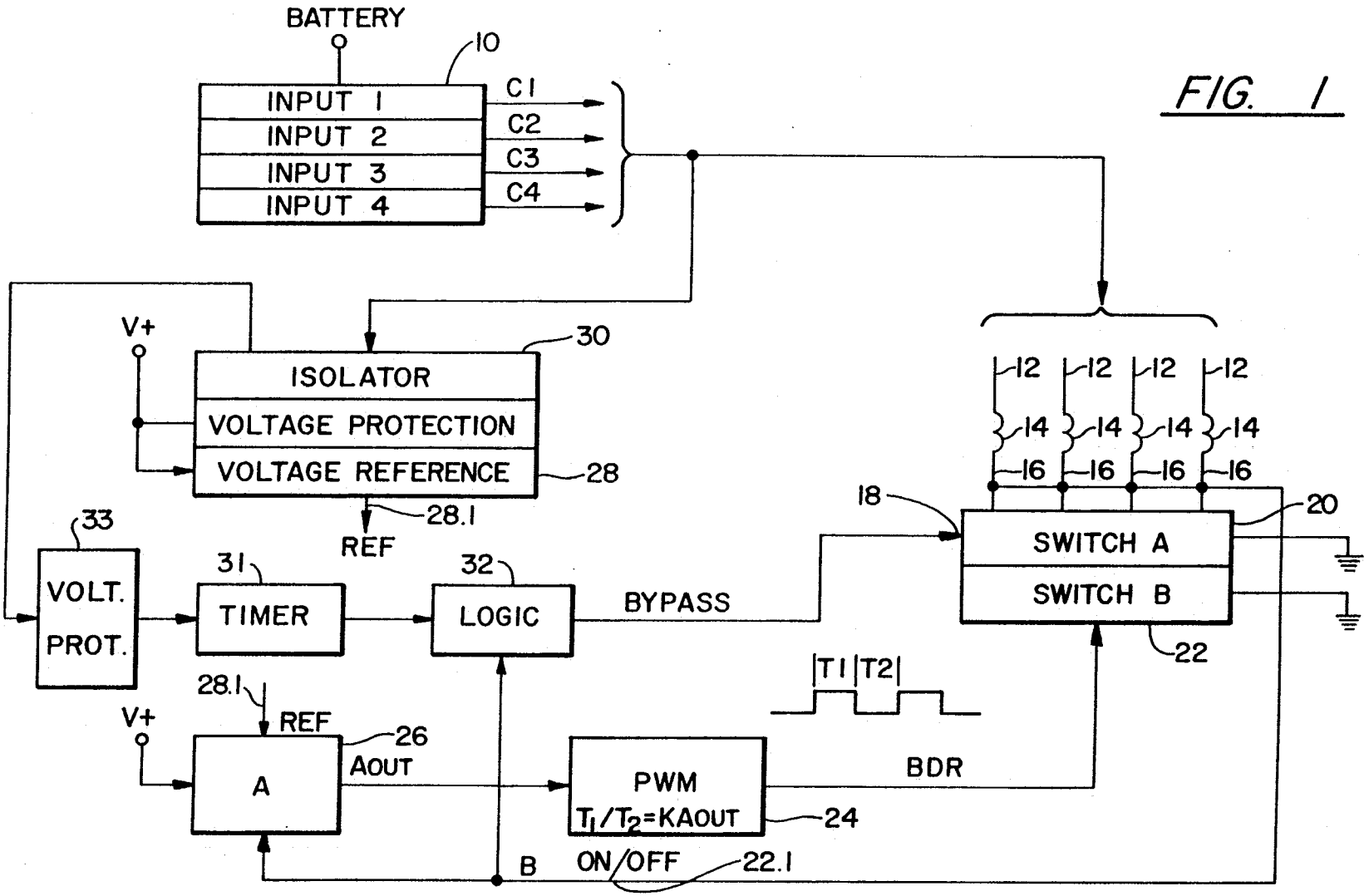
FIG. 1 is a functional block diagram of a system for regulating the voltage across a plurality of relay coils in accord with the present invention.

In FIG. 1, a common D.C. source, such a battery in an automobile, supplies power to four input devices (e.g. switches) 10 (inputs 1–4). It is through each of these devices that power is supplied to a corresponding terminal 12 of a relay coil 14. (The moveable parts of relay such as the contact arms, are not shown for convenience.) In an automobile, for instance, one input device would control the operation of a relay for the lights, another would control a relay for the directional signals.

The second terminal 16 of each coil terminal 14 is connected to a common switch 20. (SWITCH A), which has a input control terminal 18 and an output terminal. In response to the correct input signal, BYPASS, on terminal 18, switch A connects the terminals to ground through the output terminal; this completes the path between the battery and ground through the coil, allowing each coil to operate when its respective input device 10 is operated. It should be understood that during this "mode" the voltage across each coil follows the battery voltage.

Figure 3:
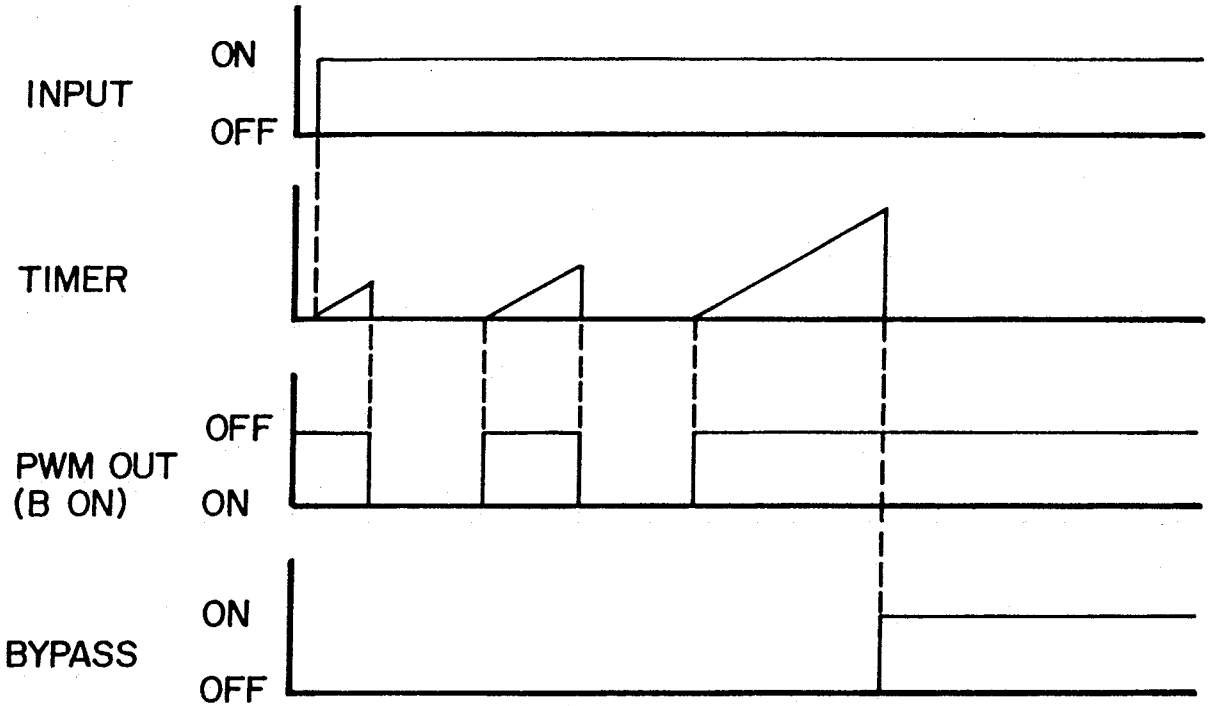
FIG. 3 shows various waveforms on a common time base.

However, if the BYPASS signal is not present the connection between the terminals 16 and ground is provided by a second switch 22 (SWITCH B) the ON and OFF time (T1/T2) of which is controlled by a pulse width modulator 24 (PWM), which produces a switch B drive control signal, BDR, that is a square wave, as shown in FIG. 1 and FIG. 3. The duty cycle of the signal BDR is proportional to the magnitude of an an input signal, A OUT signal, from a reference amplifier 26. The signal A OUT manifests the difference between the voltage applied to the terminals 16,(signal B ON/-OFF) and a reference voltage, signal REF, which is provided from a voltage reference circuit 28 on the signal line 28.1. An isolator 30 allows one regulator to be used with one battery to power more than one relay coil, the isolator preventing "sneak" paths through the input device 10 from the coils.

It can be seen, therefore, that the PWM controls the voltage across the coils collectively as direct function of the change in voltage across the coils versus the reference, and, in that way, maintains a constant power dissipation across each coil.

In the event that the PWM is faulty, the signal BYPASS is provided, causing SWITCH A to shunt SWITCH B. The signal BYPASS is produced by a logic circuit 32 (LOGIC) that determines that the signal B ON/OFF voltage (at terminal 16), does not go low in a required interval. Specifically, when an input device 10 is operated, a timer 31 is activated through a protector 33. The LOGIC circuit monitors the output of the timer against the status of signal B ON/OFF. When the switch is activated, signal B ON/OFF goes low. If the B signal ON/OFF goes low within the time interval set by the timer and the LOGIC circuit, the signal BY-PASS is not produced and the timer 31 is reset. The timer will start counting each time the signal B ON/-OFF goes back to high (Switch B is off). (See FIG. 3). As long as V+ is applied to the timer, it will start counting each time the signal RESET is produced. (See FIG. 3)

Figure 2:
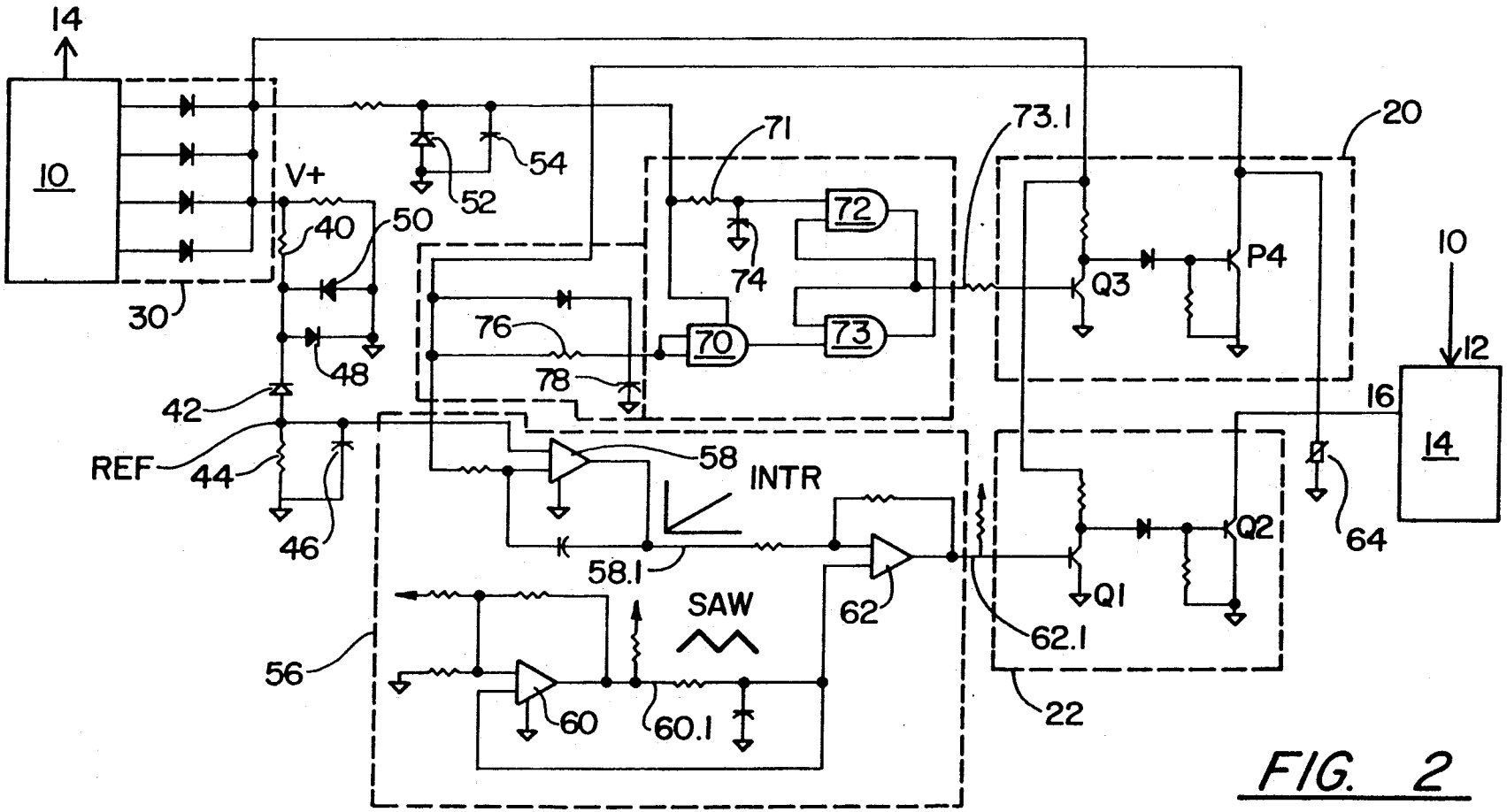
FIG. 2 is a composite of a functional block diagram and schematic of a specific embodiment of the present invention.

In FIG. 2, which shows another embodiment of the invention, the devices 10 are individually connected to diodes D1-4, which comprise the isolation circuit 30 previously discussed. The signal from the isolation circuit is provided to a protection circuit that comprises a resistor 40, a zener diode 50 and a capacitor 48 which creates the V+signal. The V+signal is used to generate the reference signal through zener diode 42 and resistor 44. Zener diode 42 plus the voltage drop across resistor 40 determine the voltage that will be seen across the coil terminals. The voltage across resistor 44 provides the signal REF that controls the duty cycle of the PWM. Capacitors 46 and 48 provide filtering. Zener diodes 50, 52 provide surge protection to the circuit components. Capacitor 54 also provides filtering across the zener 52.

Reference number 56 identifies the components that provide voltage referencing and the PWM function. An operational amplifier 58 is configured as an integrator driven by the signal REF and the signal B ON, providing an output signal INTR on line 58.1 to a comparator 62. Another operational amplifier 60 (e.g. one half of a pair) provides a saw-tooth like output signal SW on the line 60.1 that goes to the other input of the comparator 62, which thereby produces the signal BDR on output line 62.1, which controls the switch 22 (consisting of transistors Q1 and Q2) through which current can flow from the terminal 16 on any one of the coils 14. Since the slope of the output signal INTR on line 58.1 is a direct function of the magnitude of signal REF, the rate at which the comparator 62 changes state will also vary direct with REF and B ON/OFF. Varistor 64 protects the coils from overvoltage.

The functional operation of the logic 32 is provided with gates 70,72,73 in cooperation with an RC timer consisting of resistor 76 and capacitor 78 and a timer comprising resistor 71 and capacitor 74. The output of the gates, on line 73.1, controls switch 20, which comprises the transistors Q3 and Q4, the collector of transistor Q4 being connected to the collector of transistor Q2 and both being connected to terminal 16. Thus when either transistor is conducting the other is shunted. When power is applied to the circuit—when an input device 10 is activated—capacitor 74 begins to charge through resistor 71 from the output from the device 10. If with the time it takes for capacitor 74 to reach the gate turn on voltage for gate 72, transistor Q2 has not conducted (causing current flow through any one of the coils 14), the output from gate 72 will latch and turn-on transistor Q3 and transistor Q4, completing the circuit through the coil (shunting the transistor Q2). Once transistor Q2 operates, the output from gate 72 on line 73.1 will be a function of the state of gate 73, which is a function of the voltage on the capacitor 78, which charges in response to the voltage at terminal 16, thus monitoring for on and off operation of transistor Q2. In detail, the RC network of resistor 76 and capacitor 78 will operate gate 70 and gate 73 if the collector of Q2 is high too long, causing gate 72 to latch and turn on switch 20 (transistor Q4) thereby shunting switch 22. The circuit will operate in this mode, no pulse-width modulation and thus power reduction present, until the input is reset. Once reset, the circuit will attempt to pulse-width modulate the current through coil 14 when any one of S M input is re-activated.

Aided by the foregoing discussion, one skilled in the art will be able to make modifications to the described embodiments of the invention without departing from its true scope and spirit.

I claim:

1. A control for providing current from a DC power source through a plurality of coils, characterized by:

input control means, individual to each coil, operable for providing an independent connection to one terminal of the power source output from a first terminal on each coil;

a first switch having a terminal providing a common connection from a second terminal on each coil, said switch being operable to connect said terminal to a second terminal of the power source to provide current through each coil;

a second switch in parallel connection with the first switch;

switching means for controlling the operation of the second switch as a function of the voltage on the second terminal to maintain a required voltage between the first and second terminals;

logic means for activating the first switch in response to an input signal indicating incorrect operation of the second switch as a function of the voltage on the second terminal; and timing means for activating the logic means if the second switch does not operate within a set time internal following operation of the input control.

2. The control according to claim 1 characterized by:

switch timing means for activating the logic means if the switching means is off longer than a set time.

3. The control according to claim 1 characterized by:

isolation means for providing a separate connection between each control means and the first terminal on a coil controlled by the control means.

4. The control according to claim 1 characterized in that the switching means comprises a transistor switch that connects the second terminal to the power source, a pulse width modulator for providing an output signal controlling the on and off times of the transistor switch and sensing means for controlling the duty cycle of the pulse width modulator output signal as a function of variations in voltage on the first terminal to maintain constant average voltage between the first and second coil terminals.

5. The control according to claim 4 characterized by:

switch timing means for activating the logic means if the switching means is off longer than a set time.

6. The control according to claim 4 characterized by:

isolation means for providing a separate connection between each input control means and the first terminal on each coil.

7. A method for regulating power dissipation in a coil driver that provides current through a plurality of coils from a DC power source, characterized by:

installing input control means, individually to each coil, operable for providing a separate connection to a first terminal on the power source from a first terminal on each coil;

installing a first switch with a terminal that provides a common connection for a second coil terminal on each coil and for connecting said terminal to a second terminal of the power source to allow current to flow from said second terminal of power source through each coil;

installing a second switch in parallel connection with the first switch;

installing switching means for controlling the second switch as a function of the voltage on the second terminal on each coil to provide a required voltage between the first terminal on each coil and the second terminal on each coil;

installing logic means for activating the first switch in response to an input signal indicating incorrect operation of the second switch as a function of the voltage across the coils; and installing timing means for activating the logic means if the second switch does not operate within a set time interval following operation of the input control.

8. The method described in claim 7 characterized by: installing switch timing means for activating the logic means if the switching means is off longer than a set time.

9. The method described in claim 7, characterized by: installing a transistor switch that connects the second terminal on each coil to the second terminal on the power source, installing a pulse width modulator for providing an output signal controlling the on and off times of the transistor switch, and installing sensing means for controlling the duty cycle of the pulse width modulator output signal as a function of variations in voltage on the second terminal on each coil to maintain constant average voltage between the first and second terminals on each coil.

10. The method described in claim 7 or 9 characterized by: installing isolation means for providing a separate connection between each control means and the first terminal on each coil.

11. The method described in claim 9 characterized by: installing timing means for activating the logic means if the first switch does not operate within a set time interval following operation of the input control.

12. The method described in claims 9 or 11 characterized by: installing switch timing means for activating the logic means if the switching means is off longer than a set time.

* * * * *